United States Patent [19]

Gebert

[11] Patent Number: 4,951,819

[45] Date of Patent: Aug. 28, 1990

[54] FLEXIBLE KEY CASE

[75] Inventor: Paul Gebert, Cartersville, Ga.

[73] Assignee: Key Keepr, Inc., Cartersville, Ga.

[21] Appl. No.: 448,676

[22] Filed: Dec. 11, 1989

Related U.S. Application Data

[63] Continuation-in-part of Ser. No. 397,657, Aug. 23, 1989.

[51] Int. Cl.[5] ..... A45G 11/32

[52] U.S. Cl. ..... 206/37.2; 70/456 R

[58] Field of Search ..... 206/37.1–37.8; 70/456 R

[56] References Cited

U.S. PATENT DOCUMENTS

| | | | |
|---|---|---|---|
| 1,110,760 | 9/1914 | Easton | 206/37.8 |
| 1,139,370 | 5/1915 | Putnam | 206/37.1 X |
| 1,414,798 | 5/1922 | Welcker | 206/37.1 |
| 1,766,801 | 6/1930 | Ragsdale | 206/37.2 |
| 1,927,195 | 9/1933 | Zimmerman | 206/37.2 |
| 2,076,895 | 4/1937 | Johnston | 206/37.2 |
| 2,176,863 | 10/1939 | Nash | 206/37.2 |
| 2,546,413 | 3/1951 | Williams | 206/37.2 |
| 2,912,030 | 11/1959 | Stiller | 206/37.2 |
| 3,354,678 | 11/1967 | Stifelman | 206/37.2 X |
| 4,697,698 | 10/1987 | Holdener | 206/37.2 X |

FOREIGN PATENT DOCUMENTS

| | | | |
|---|---|---|---|
| 719821 | 2/1932 | France | 206/37.1 |
| 958994 | 9/1949 | France | 206/37.2 |
| 266740 | 8/1929 | Italy | 206/37.1 |
| 286785 | 3/1928 | United Kingdom | 206/37.1 |
| 316859 | 11/1929 | United Kingdom | 206/37.2 |
| 419005 | 11/1934 | United Kingdom | 206/37.1 |

*Primary Examiner*—William I. Price

[57] ABSTRACT

A flexible key case is provided which contains an upper end portion, a lower end portion with an opening, and a sidewall extending between the upper and lower end portions. The sidewall has a longitudinal slot and defines a cavity that is accessible through the slot and through the opening of the lower end portion. The key case includes a key ring and means, connected to the key ring, for raising the key ring into the cavity adjacent the upper end portion and lowering the key ring from the cavity through the opening of the lower end portion. The key case holds a plurality of keys in a neat, compact package that shields the keys from contact with a pocket or purse and minimizes jingling. Keys are easily added or removed from the key case and the key case is simple to operate.

8 Claims, 3 Drawing Sheets

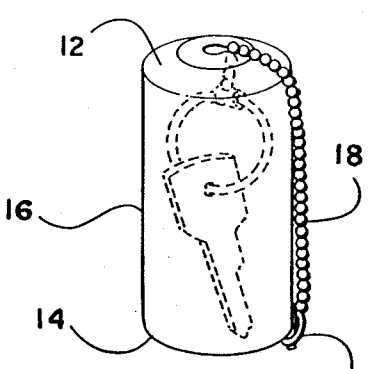
Fig. 1
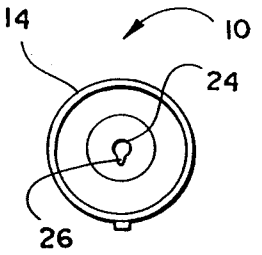
Fig. 2
Fig. 3
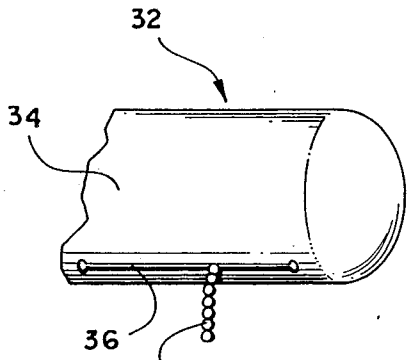
Fig. 4
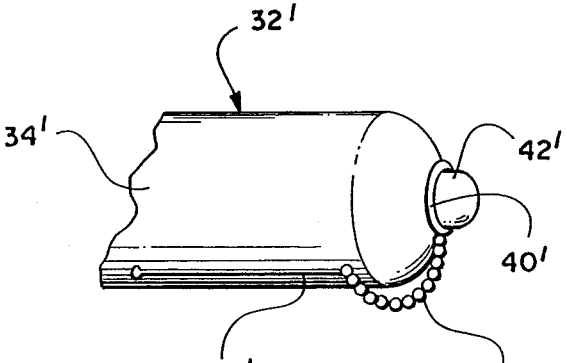
Fig. 5

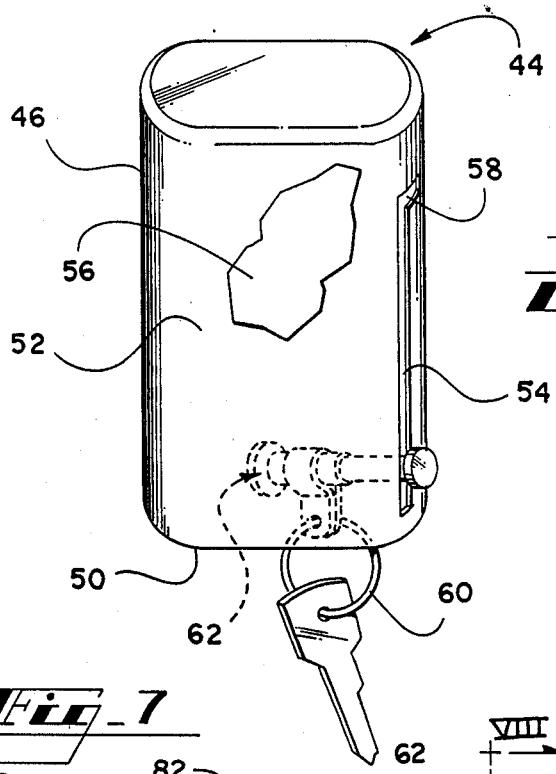
Fig. 6
Fig. 7
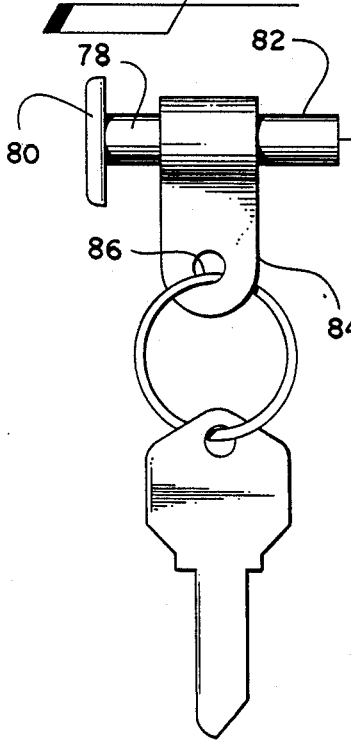
Fig. 8
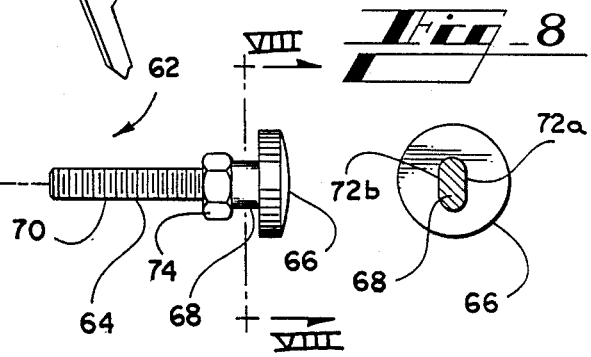
Fig. 9
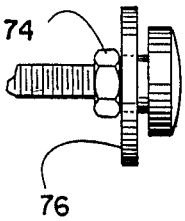

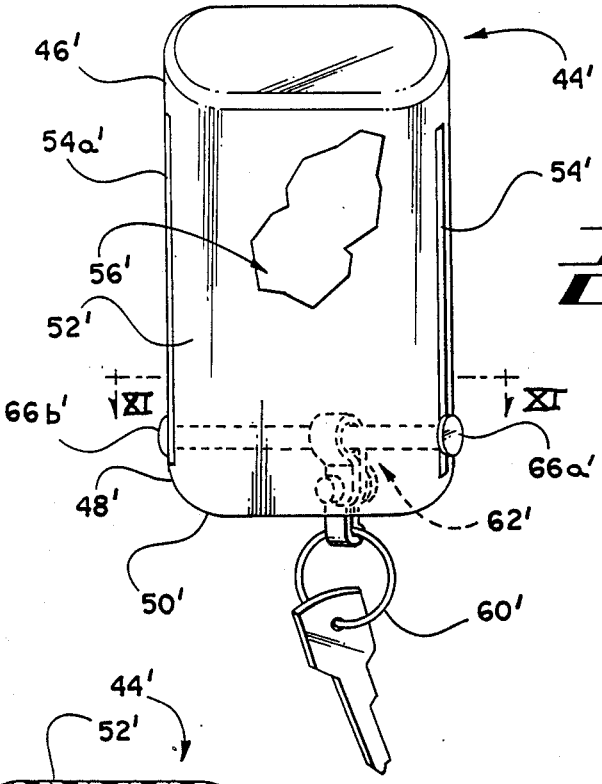
Fig. 10
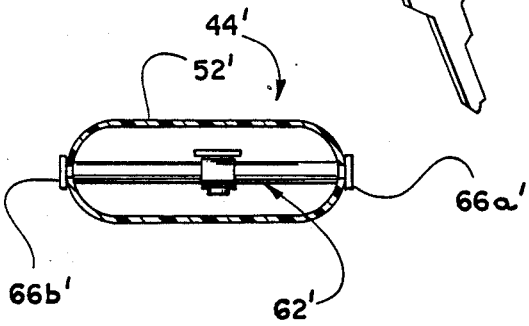
Fig. 11
Fig. 12
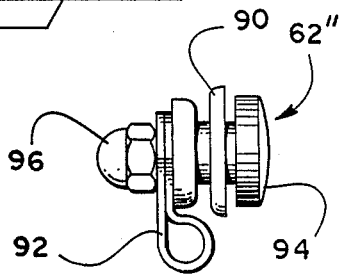

FLEXIBLE KEY CASE

CROSS REFERENCE TO RELATED APPLICATIONS

This application is a continuation-in-part of application Ser. No. 07/397,657 filed Aug. 23, 1989.

TECHNICAL FIELD

This invention relates generally to keys, and more particularly relates to a key case for holding a plurality of keys.

BACKGROUND OF THE INVENTION

Keys are a necessary item in modern society. A typical person has a variety of keys to gain access to his home, automobile and place of employment. Many people will have two keys for each automobile, and a key for each door of their home or apartment. In addition, in the home, a person may have keys to fit safes, medicine cabinets, freezers, desks and other items. In the office, a person may also have several keys. It is apparent that a person has need for a plurality of keys.

A person typically keeps a plurality of keys on a key ring or in a key case for convenience. Unfortunately, carrying keys in a trouser pocket on a key ring exposes the trouser pocket to damage from the keys which may rub or poke holes in the pocket. Keys can also damage a jacket or other garment if carried in a pocket. Keys on a key ring can similarly damage a purse. Also, keys carried on a key ring have a tendency to jingle making an annoying noise.

Keys kept in a key case do not make as much annoying noise as keys kept on a key ring, but key cases tend to be bulky items. In a key case, the keys are arranged on a bar in a linear fashion with the bar dictating the size of the key case. A key case to hold several keys usually has a long bar and can be quite bulky and therefore undesirable. A bulky key case also damages pockets and can distort the lining of a jacket if kept in the jacket pocket.

Another problem with keys today is the large size of some keys, particularly automobile keys. Many automobile keys are not only large but have their heads encased in rubber or plastic material. These keys do not lie flat on small key rings and increase the size of the key case needed for them. It will be appreciated that it would be highly desirable to have a key case for carrying a plurality of keys that is not bulky and keeps the keys from making annoying noises when carried in a pocket or purse.

SUMMARY OF THE INVENTION

The present invention is directed to overcoming one or more of the problems set forth above. Briefly summarized, according to one aspect of the invention, a key case contains an upper end portion, a lower end portion with an opening, and a sidewall having a longitudinal slot. The sidewall extends between the upper and lower end portions and defines a cavity that is accessible through the longitudinal slot and through the opening of the lower end portion. The key case includes a key ring, and means, connected to the key ring, for raising the key ring into the cavity adjacent the upper end portion and lowering the key ring from the cavity through the opening of the lower end portion.

It is an object of the present invention to provide a key case for housing a plurality of keys. The key case accommodates a number of keys depending on the size of the key ring used.

Another object of the present invention to provide a key case that prevents keys from poking or wearing holes in a pocket. The key case housing shields the purse or pocket from the keys and thereby prevents the keys from poking holes. The key case is compact to minimize wear. The keys lay almost flat on the key ring thereby minimizing bulging of the key case.

Another object of the invention is to provide a key case that is easy to use. The key case holds keys on a conventional key ring and the keys are easily removed or added.

These and other aspects, objects, features and advantages of the present invention will be more clearly understood and appreciated from a review of the following detailed description of the preferred embodiments and appended claims, and by reference to the accompanying drawings.

BRIEF DESCRIPTION OF THE DRAWINGS

FIG. 1 is a diagrammatic perspective view of a preferred embodiment of a key case according to the present invention.

FIG. 2 is a left end view of the key case of FIG. 1.

FIG. 3 is a front view of the key case of FIG. 1 illustrating the key case in an upright position with keys stored inside.

FIG. 4 is a diagrammatic perspective view of a key case view similar to FIG. 1, but illustrating another preferred embodiment.

FIG. 5 is a view similar to FIG. 4, but illustrating another preferred embodiment.

FIG. 6 is a perspective view of another preferred embodiment of a key case illustrating a key case free of chains.

FIG. 7 is a somewhat enlarged perspective view of a portion of the key case of FIG. 6.

FIG. 8 is a sectional view taken along line VIII—VIII of FIG. 7.

FIG. 9 is a view similar to FIG. 7, but illustrating another preferred embodiment.

FIG. 10 is a is a perspective view similar to FIG. 6, but illustrating another preferred embodiment.

FIG. 11 is a sectional view taken along line XI—XI of FIG. 10.

FIG. 12 is is a view similar to FIGS. 7 and 9, but illustrating another preferred embodiment.

DETAILED DESCRIPTION OF THE PREFERRED EMBODIMENTS

Referring now to the drawings, in which like numerals indicate like elements throughout the several figures, FIG. 1 illustrates a flexible key case 10 that has an upper end portion 12, a lower end portion 14, and a sidewall 16 extending between the upper end portion 12 and the lower end portion 14. The key case 10 is equipped with a chain 18 and a key ring 20 attached to one end of the chain 18. One or more keys 22 are attached to the key ring 20. A section of the sidewall 16 is cut away revealing the chain 18 passing through the interior of the key case 10. The upper end portion 12 has an opening 24 through which the chain 18 passes. The opening 24 has a notch or groove 26 which entraps the chain 18 to keep the chain 18 from sliding through the opening 24 and also locking the chain 18 in position to suspend the key ring 20 and keys 22 at a desired position either protruding from the key case 10 or stored inside the key case 10.

Referring to FIGS. 2–3, the key case 10 is illustrated with a cylindrical configuration. The upper end portion 12 of the key case 10 is tapered to reduce the bulk of the key case 10 and to allow the key ring 20 to travel to the uppermost portion of the upper end portion 12 of the key case 10. The sidewall 16 of the key case 10 has a protrusion 28 that extends beyond the lower end portion 14 of the key case 10 for engaging a ring 30 that is on one end of the chain 18. When the ring 30 is engaged with the protrusion 28, the portion of the chain 18 extending from the key case 10 is held in position so that it does not jingle or flop around in an annoying manner and maintains the key ring 20 in position.

The key case 10 may have a compressed cylindrical or oval-shaped configuration to accommodate a larger key ring 20 and therefore more keys. The upper end portion 12 may also be rounded to allow the key ring 20 to be pulled into the key case 10 to the uppermost portion of the upper end portion 12. The oval-shaped configuration is preferable where the key case 10 is to be carried in a pocket requiring a flat or thin case to avoid bulges in the pocket.

In operation, keys 22 are slipped onto the key ring 20 side by side and lay against one another in a compact bundle. Because the keys 22 lay on their sides, they form a flat bundle equal to the thickness of two or three keys, or so, depending on the sizes and shapes of the keys 22. The keys 22 are pulled into the key case 10 by pulling on the chain 18. The chain 18 is engaged with the slot 26 and locked in position to suspend the key ring 20 and keys 22 adjacent the upper end portion 12 of the key case 10. The loose end of the chain 18 is equipped with a ring 30 that may be hooked over the protrusion 28 to further keep the keys 22 suspended and to keep the chain 18 from jingling. The ring 30 may be also be used to carry a particular key, such as a house key or automobile key. It is particularly helpful to attach an automobile key to the ring 30 so that the automobile key is always ready for immediate use without. This feature is helpful in high crime areas where it is desired to gain entry as quickly as possible without delays caused by fumbling for the right key.

The keys 22 are lowered by removing the ring 30 from the protrusion 28, disengaging the chain 18 from the slot 26, and lowering the chain 18 through the opening 24. When the keys 22 protrude from the lower end portion 14 of the key case 10, they are ready for use. The ring 30 has a size sufficient for preventing the chain 18 from falling through the opening 24.

Referring to FIG. 4, a key case 32 is illustrated which has a sidewall 34 with a slot 36 therein. A chain 38 protrudes through the slot 36. The end of the chain 38 on the interior of the sidewall 34 contains a key ring for holding a plurality of keys. The key ring is raised and lowered by moving the chain 38 along the slot 36. The advantage of this configuration is that the chain length is minimal because it does not have to come through an opening in the uppermost portion of the key case 32.

Referring to FIG. 5, a key case 32′ is illustrated which has a sidewall 34′ with a slot 36′ therein. A chain 38′ protrudes through the slot 36′ and has a key ring attached to one end on the interior of the sidewall 34′. The other end of the chain 38′ has a ring 40 attached thereto. The ring 40 is engageable with a neck or protrusion 42 on the key case 32′ to hold the chain 38′ in position to reduce noise. The engagement of the ring 40 with the neck 42 of the key case 32′ also secures the key ring in its uppermost position.

Referring now to FIG. 6, a key case 44 has an upper end portion 46, a lower end portion 48 having an opening 50, and a sidewall 52. The upper end portion 46 forms a cap or crown for the key case 44 and may be flat or rounded or otherwise contoured to have a smooth, convenient, streamlined shape for easily fitting in the hand or a pocket.

The sidewall 52 has a longitudinal slot 54 extending from a location adjacent the lower end portion 48 to a location adjacent the upper end portion 46. The sidewall 52 extends between the upper and lower end portions 46, 48 and defines a cavity 56. The cavity 56 is accessible through the opening 50 of the lower end portion 48, and is also accessible through the longitudinal slot 54.

As illustrated in FIG. 6, the longitudinal slot 54 resides in the sidewall 52 and is vertically oriented running parallel to the sidewall 52. The top end of the longitudinal slot 54 is preferably tapered so that its upper end is narrower than its lower end. The slot 54 may have a notch 58. The notch 58 may be thought of as a transverse or horizontal slot that intersects the longitudinal slot 54 at a location adjacent said upper end portion 46. Preferably, the transverse slot 58 is generally perpendicular to the longitudinal slot 54. The notch 58 is preferably narrow like the top end of the longitudinal slot 54. The longitudinal slot 54 may be oriented diagonally along the sidewall 52, or may have another orientation as long as its bottom end is adjacent the lower end portion 48 and its upper end is adjacent the upper end portion 46.

The key case 44 may be conveniently constructed of a resinous material that is capable of being molded and slot while retaining a soft, flexible physical characteristic. One such material suitable for the key case 44 is polyethylene. There are many polymeric materials well suited for a flexible key case. With polyethylene, a longitudinal slot 54 requires a thinner sidewall 52 than does a diagonal slot. A diagonal slot would require a thicker sidewall 54 to maintain the physical integrity and functionality of the key case 44. To increase the flexibility of the sidewall 52, the sidewall 52 may be made thinner and the edges of the slot 54 made thicker or reinforced to achieve the desired strength and rigidity.

Referring now to FIGS. 6–8, the key case 44 includes a key ring 60 for holding a plurality of keys. The size of the key ring 60 is dictated by the number and type of keys to be carried. Modern automobile keys with the big heads require a larger diameter key ring 60 than would smaller household keys. Various size key rings 60 are easily accommodated in the key case 44 by appropriately sizing the cross section of the key case 44. The advantage of large key ring 60 is that it encourages keys to lie flat so that the thickness of the bundle of keys is kept at a minimum thereby keeping the thickness of the key case 44 at a minimum.

The key case 44 also includes means 62 for raising the key ring 60 into the cavity 56 adjacent the upper end portion 46 and lowering the key ring 60 from the cavity 56 through the opening 50 of the lower end portion 48. The means 62 is connected to the key ring 60 and acts in concert with longitudinal slot 54 to raise and lower the key ring 60.

The means 62 for raising the key ring 60 includes a first threaded member 64 that has a cap 66, a neck 68 attached to the cap 66, and a threaded body 70 attached to the neck 68. The neck 68 is of a size sufficient for riding in the slot 54. The cap 66 is larger than the neck 68 to prevent the neck 68 from exiting the slot 54 through the cavity 56. The neck 68 preferably has two flat longitudinal sides 72*a*, 72*b* that contact and ride along the sides of the longitudinal slot 54. As the slot 54 tapers near its top end, the neck 68 becomes squeezed or trapped between the sides of the slot 54, and the first threaded member is thereby suspended in a position along the sidewall 52 near the first end portion 46. The neck 68 may be urged along the slot 54 into the notch 58 where it will remain suspended indefinitely requiring a positive force to urge it from the notch 58 back into the longitudinal slot 54.

Referring to FIGS. 7 and 9, a nut 74 is threaded onto the threaded body 70 of the first threaded member 64 to a position adjacent the neck 68. The nut 74 is preferably larger than the neck 68 to prevent the neck 68 from exiting the cavity 56 through the slot 54. By this construction, the neck 68 is forced to remain in the slot 54 being prevented from inadvertently slipping out of place in one direction by the cap 66 and in the other direction by the nut 74. The ease with which the neck 68 traverses the slot 54 can be influenced by the length of the neck 68. A short neck 68, for example, will allow the nut 74 to press against the slot 54 creating a friction that makes the neck 68 difficult to move along the slot 54.

A washer or spacer 76 may be fitted on the neck 68 in the cavity 56 to ride along the interior of the sidewall 52 along the longitudinal slot 54. The washer 76 can compensate for variances in the length of the neck 68, or the thickness of the sidewall 52 in the area of the slot 54. Preferably, the spacer 76 has an opening with two flat longitudinal sides adapted to fit over the two flat longitudinal sides 72*a,b* of the neck 68. The spacer 76 abuts the nut 74 and presses against the sidewall 52 containing the slot 54 in response to being urged in that direction by the nut 74.

Referring now to FIGS. 6–7, a second threaded member 78 has an end flange 80 and is threadably mateable with the threaded body 70 of the first threaded member 64. Preferably, the second threaded member 80 has a hollow, internally threaded shaft 82 that mates with the threaded body 70. This structure is similar to a binder post having one internally threaded member and one externally threaded member. Because the members 64, 80 are threaded, their overall length may be varied by engaging more or fewer threads. Maximum thread engagement would be used, for example, where a small key ring 60 is used. On the other hand, less thread engagement would be used for a larger key ring 60. Lesser thread engagement places the internally threaded shaft 82 a greater distance from the slot 54 than more thread engagement to accommodate a larger key ring 60.

A strap, band or clamp 84 is positioned about the internally threaded shaft 82. Preferably, the clamp 84 has two openings 86 that are aligned so that the key ring 60 may be inserted through them. The clamp 84 is preferably pivotally movable or rotatable relative to the shaft 82. While a two-eyed P-clamp 84 is preferable, a one eyed C-clamp works well also. With a one-eyed clamp 84, the clamp material would have to be a bit more rigid so that it stays on the shaft 82.

Referring now to FIGS. 10–11, the key case 44' has an upper end portion 46', a lower end portion 48' having an opening 50', and a sidewall 52'. The upper end portion 46' forms a cap or crown for the key case 44'. The sidewall 52' has a longitudinal slot 54' extending from a location adjacent the lower end portion 48' to a location adjacent the upper end portion 46'. Diametrically opposite the slot 54' is another slot, 54*a*. Slot 54*a* extends from a location adjacent the lower end portion 48' to a location adjacent the upper end portion 46'. The sidewall 52' extends between the upper and lower end portions 46', 48' and defines a cavity 56'. The cavity 56' is accessible through the opening 50' of the lower end portion 48, and is also accessible through the longitudinal slots 54', 54*a*. The longitudinal slots 54', 54*a* reside in the sidewall 52' and are vertically oriented running parallel to the sidewall 52'. The top ends of the longitudinal slots 54', 54*a* are preferably tapered so that their upper ends are narrower than their lower ends.

Still referring now to FIGS. 10–11, the key case 44' includes a key ring 60' for holding keys and means 62' for raising the key ring 60' into the cavity 56' adjacent the upper end portion 46' and lowering the key ring 60' from the cavity 56' through the opening 50' of the lower end portion 48'. The means 62' is connected to the key ring 60' and acts in concert with longitudinal slots 54', 54*a* to raise and lower the key ring 60'.

The means 62' for raising the key ring 60' includes a member 64' that has end caps 66*a'*, 66*b'*. The member 64' rides in the slots 54', 54*a'*. As the slots 54', 54*a'* taper near their top ends, the member 64' becomes squeezed or trapped between the sides of the slot 54' and is thereby suspended in a position along the sidewall 52' near the first end portion 46'. It will remain suspended indefinitely requiring a positive force to dislodge it.

Referring to FIGS. 6 and 12, the means 62'' for raising the key ring comprises a wheel-shaped member 90 that has an H-shaped configuration. The cross member of the H rides along the longitudinal slot 54 with the left leg of the H in the cavity 56 and the right leg of the H adjacent the exterior of the sidewall 52. A P-clamp 92 or other holding device is preferably integrally formed with the left leg of the H so that there is a one-piece unitary structure that rides along the slot 54 and raises and lowers the key ring 60. Alternatively, the member 90 has a bore through which a threaded member 94 is inserted, and clamp 92 is a separate member that is mounted on the threaded member 90 adjacent the left leg of the H-shaped member 90. A cap nut 96 keeps the assembly together.

While operation of the present invention is believed to be apparent from the foregoing description and drawings, a few words will be added for emphasis. The key case 44 is assembled by sliding a washer 76 over the threaded shaft 70 onto the neck 68, and aligning the flat sides of the washer with the flat sides 72*a,b* of the neck 68. The nut 74 is then threaded onto the shaft 70 and advanced until it abuts the neck 68. The hollow shaft 82 is then engaged with the threaded shaft 70. The clamp 84 is installed on the hollow shaft 82 and the key ring 60 is inserted through the eyes 86 of the clamp 84. This assembled structure is inserted into the cavity 56 and the cap 66 is pushed through the longitudinal slot 54. The structure is manipulated until the flat sides 72*a,b* of the neck 68 are parallel to the sides of the slot 54 and capable of riding along the slot 54. The key ring 60 is lowered to its lowermost position by pushing the cap 66 to the bottom of the longitudinal slot 54.

In its lowermost position, the key ring 60 extends from the cavity 56 and is easily accessible for adding or removing keys. When the keys desired are on the ring 60, the cap 66 is pushed toward the top of the slot 54.

Because the longitudinal slot 54 is tapered, the ease with which the cap 66 is urged toward the top diminishes as it nears the top. The pushing force can be removed and the structure will remain suspended with the neck 68 wedged in the tapered portion of the slot 54. If desired, the cap 66 may be pushed further until the end of the longitudinal slot 54 is reached and the notch 58 is encountered. The cap 66 can be slipped into the notch 58 and will remain there. In this raised position, the key ring 60 is on the inside of the key case 44 in the cavity 56 with the keys contained within the sidewall 52.

It can now be appreciated that there has been described a key case for housing a plurality of keys. The key case accommodates a number of keys depending on the size of the key ring used. The key case prevents keys from poking or wearing holes in a pocket. The key case housing shields the purse or pocket from the keys and thereby prevents the keys from poking holes. The key case is compact to minimize wear. The keys lay almost flat on the key ring thereby minimizing bulging of the key case. The key case holds keys on a conventional key ring and the keys are easily removed or added.

It can also be appreciated that the key case holds a plurality of keys in a neat, compact package that shields the keys from contact with a pocket or purse and minimizes jingling. Keys are easily added or removed from the key case and the key case is simple to operate.

As is evident from the foregoing description, certain aspects of the invention are not limited to the particular details of the examples illustrated, and it is therefore contemplated that other modifications and applications will occur to those skilled the art. Also, while the invention has been described primarily of plastic construction, it can be constructed of leather, cloth or other materials. It is accordingly intended that the claims shall cover all such modifications and applications as do not depart from the true spirit and scope of the invention.

I claim:

1. A key case, comprising:

an upper end portion;

a lower end portion having an opening;

a sidewall having a longitudinal slot extending from a location adjacent said lower end portion to a location adjacent said upper end portion, said sidewall extending between said upper and lower end portions and defining a cavity, said cavity being accessible through said opening of said lower end portion and through said longitudinal slot;

a single key ring having a size sufficient for holding a plurality of keys; and means, connected to said key ring and acting in concert with said longitudinal slot, for raising said key ring into said cavity to a fixed position adjacent said upper end portion and lowering said key ring from said cavity through said opening of said lower end portion, said means including a single wheel-shaped member having an H-shaped configuration with a crossmember of the H riding along said slot with a left leg of the H in said cavity and a right leg of said H outside said cavity adjacent said sidewall, said key ring being held in a raised position in said cavity solely by said slot acting in concert with said crossmember, said longitudinal slot tapering near said upper end portion and said sidewall having a transverse slot intersecting said longitudinal slot at a location adjacent said upper end portion, said wheel-shaped member holding said key ring raised in said cavity adjacent said upper end portion in response to being urged through said longitudinal slot taper into said transverse slot.

2. A key case, comprising:

an upper end portion;

a lower end portion having an opening;

a sidewall having a longitudinal slot extending from a location adjacent said lower end portion to a location adjacent said upper end portion, said sidewall extending between said upper and lower end portions and defining a cavity, said cavity being accessible through said opening of said lower end portion and through said longitudinal slot;

a single key ring having a size sufficient for holding a plurality of keys;

means, connected to said key ring and acting in concert with said longitudinal slot, for raising said key ring into said cavity to a fixed position adjacent said upper end portion and lowering said key ring from said cavity through said opening of said lower end portion, said means including a single wheel-shaped member having an H-shaped configuration with a crossmember of the H riding along said slot with a left leg of the H in said cavity and a right leg of said H outside said cavity adjacent said sidewall, said key ring being held in a raised position in said cavity solely by said slot acting in concert with said crossmember;

said means for raising said key ring including:

a bore extending through said crossmember of said wheel-shaped member;

a threaded member extending through said bore; and a clamp having an opening for attaching said key ring and being positioned about said threaded member adjacent said wheel-shaped member inside said cavity.

3. A key case, comprising:

an upper end portion;

a lower end portion having an opening;

a sidewall having a longitudinal slot extending from a location adjacent said lower end portion to a location adjacent said upper end portion, said sidewall extending between said upper and lower end portions and defining a cavity, said cavity being accessible through said opening of said lower end portion and through said longitudinal slot;

a single key ring having a size sufficient for holding a plurality of keys;

means, connected to said key ring and acting in concert with said longitudinal slot, for raising said key ring into said cavity to a fixed position adjacent said upper end portion and lowering said key ring from said cavity through said opening of said lower end portion, said means including a single wheel-shaped member having an H-shaped configuration with a crossmember of the H riding along said slot with a left leg of the H in said cavity and a right leg of said H outside said cavity adjacent said sidewall, said key ring being held in a raised position in said cavity solely by said slot acting in concert with said crossmember; said sidewall having a second longitudinal slot with said crossmember of said wheel-shaped member riding in said second slot.

4. A key case, as set forth in claim 1, wherein said longitudinal slot is tapered near said upper end portion to hold said wheel-shaped member at a preselected location.

5. A key case, as set forth in claim 1, wherein said key ring is moveable between a raised position at which said key ring is adjacent said upper end portion and a lowered position at which said key ring extends from said cavity and is free of said sidewall.

6. A key case, as set forth in claim 1, wherein said slot tapers near said upper end portion to entrap said cross-member of said wheel-shaped member to thereby hold said key ring in said cavity adjacent said upper end portion.

7. A key case, as set forth in claim 1, wherein said means for raising said key ring includes:

a clamp having an opening for attaching said key ring and being integrally formed with said wheel-shaped member.

8. A key case, as set forth in claim 2, including a cap nut threadably engaged on said threaded member to thereby maintain said clamp adjacent said wheel-shaped member.

* * * * *